US009897341B2

(12) United States Patent
Suzuki et al.

(10) Patent No.: US 9,897,341 B2
(45) Date of Patent: Feb. 20, 2018

(54) HEAT PUMP WATER HEATING SYSTEM

(71) Applicant: Mitsubishi Electric Corporation, Tokyo (JP)

(72) Inventors: Kazutaka Suzuki, Tokyo (JP); Hirokazu Minamisako, Tokyo (JP); Shigeru Iijima, Tokyo (JP); Seiji Furukawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 227 days.

(21) Appl. No.: 14/683,172

(22) Filed: Apr. 10, 2015

(65) Prior Publication Data

US 2016/0010890 A1 Jan. 14, 2016

(30) Foreign Application Priority Data

Jul. 10, 2014 (JP) ..... 2014-142466

(51) Int. Cl.
*F24H 4/04* (2006.01)
*F24D 17/00* (2006.01)
(Continued)

(52) U.S. Cl.
CPC ..... *F24H 4/04* (2013.01); *F24D 17/0031* (2013.01); *F24D 17/02* (2013.01);
(Continued)

(58) Field of Classification Search
CPC ..... F24H 4/04; F24H 9/2021; F24D 17/0031; F24D 19/1054; F24D 17/02; F24D 3/08
See application file for complete search history.

(56) References Cited

U.S. PATENT DOCUMENTS 2,744,880 A * 5/1956 Brown ..... B08B 9/0555 106/14.34
4,315,597 A * 2/1982 Garraffa, Jr. ..... F24D 17/02 237/2 B
(Continued)

FOREIGN PATENT DOCUMENTS

CN 203375700 U 1/2014
JP 2009-243808 A 10/2009
(Continued)

OTHER PUBLICATIONS

Extended European Search Report dated Feb. 4, 2016 in the corresponding EP application No. 15163942.4.
(Continued)

*Primary Examiner* — Kun Kai Ma
(74) *Attorney, Agent, or Firm* — Posz Law Group, PLC

(57) ABSTRACT

A controller of a heat pump water heating system drives circulation pumps, and uses a heat pump unit to increase a temperature of tank water within a hot water storage tank via a plate heat exchanger if the temperature of the tank water detected from a temperature sensor is lower than a heat source switch tank temperature, and the controller stops one of the circulation pump, drives other circulation pumps, and uses a boiler to increase the temperature of the tank water within the hot water storage tank via the plate heat exchanger in a shorter time than that of a case in which the heat pump unit is used to increase the temperature if the temperature of the tank water detected from the temperature sensor is equal to or higher than the heat source switch tank temperature.

2 Claims, 4 Drawing Sheets

(51) Int. Cl.
*F24D 17/02* (2006.01)
*F24D 19/00* (2006.01)
*F24D 19/10* (2006.01)
*F24H 9/20* (2006.01)

(52) U.S. Cl.
CPC ..... *F24D 19/0092* (2013.01); *F24D 19/1054* (2013.01); *F24H 9/2021* (2013.01)

(56) References Cited

U.S. PATENT DOCUMENTS 4,330,309 A * 5/1982 Robinson, Jr. ..... F24D 19/1054 237/2 B
4,512,387 A * 4/1985 Rodriguez ..... F01K 27/02 122/451 R
4,955,930 A * 9/1990 Robinson, Jr. ..... F24H 4/04 237/2 B
5,052,187 A * 10/1991 Robinson, Jr. ..... F24H 4/04 237/2 B
5,351,502 A * 10/1994 Gilles ..... F24F 5/0096 62/238.7
8,365,686 B2 * 2/2013 Matsuoka ..... F24H 9/2021 122/14.1
2005/0022542 A1 * 2/2005 Sakakibara ..... F24D 19/1054 62/183
2006/0049184 A1 * 3/2006 Garboski ..... F24D 3/08 219/688
2006/0246325 A1 * 11/2006 Miyauchi ..... H01M 8/04029 429/429
2008/0063902 A1 * 3/2008 Kawasaki ..... H01M 8/04007 429/10
2008/0216986 A1 * 9/2008 Sweet ..... F24D 11/003 165/45
2009/0107128 A1 * 4/2009 Yuri ..... F02G 5/00 60/320
2009/0113911 A1 * 5/2009 Nakayama ..... F24D 17/02 62/238.6
2009/0117426 A1 * 5/2009 Harada ..... C01B 3/384 429/412
2010/0186604 A1 * 7/2010 Otake ..... F25B 29/003 99/455
2010/0326428 A1 * 12/2010 Engelhart ..... F24D 17/0021 126/609
2011/0269041 A1 * 11/2011 Matsumoto ..... F24D 17/00 429/429
2011/0315093 A1 * 12/2011 Minamisako ..... F24D 11/0214 122/1 R
2013/0337352 A1 * 12/2013 Miyauchi ..... H01M 8/04223 429/416
2014/0103649 A1 * 4/2014 Tohoda ..... F24D 11/005 290/2
2014/0174117 A1 * 6/2014 Aoyagi ..... F24D 3/18 62/238.1
2014/0291411 A1 * 10/2014 Tamaki ..... F24D 3/18 237/2 B
2014/0353143 A1 * 12/2014 Shibata ..... F24D 17/02 204/241
2015/0121913 A1 * 5/2015 Kato ..... F25B 47/025 62/81
2015/0226453 A1 * 8/2015 Nomoto ..... F24H 4/04 62/238.7
2015/0338129 A1 * 11/2015 Matsuzawa ..... F24H 4/04 122/14.3
2016/0370122 A1 * 12/2016 Fu ..... F24D 3/18
2017/0023263 A1 * 1/2017 Tamaki ..... F24H 1/00
2017/0167809 A1 * 6/2017 Becquin ..... F04B 47/06

FOREIGN PATENT DOCUMENTS

JP 2009243808 A * 10/2009
JP 2010-65852 A 3/2010
WO WO 2013084301 A1 * 6/2013 ..... F24D 3/18

OTHER PUBLICATIONS

Office Action dated Aug. 29, 2017 issued in corresponding CN patent application No. 201510280680.1 (and English translation).

* cited by examiner

HEAT PUMP WATER HEATING SYSTEM

TECHNICAL FIELD

The present invention relates to a heat pump water heating system, and particularly, to scale deposition in a heat exchanger.

BACKGROUND ART

As a conventional water heating system, there is disclosed a water heating system including a water-refrigerant heat exchanger that performs heat exchange between refrigerant and tank water by using a heat pump as a heat source, a hot water/cold water supply circuit that returns the tank water boiled by the heat exchange in the water-refrigerant heat exchanger to a tank and stores the tank water therein, and control means that performs a boiling operation by operating a pump provided in the hot water/cold water supply circuit, feeding the tank water to the water-refrigerant heat exchanger by the pump, and boiling the tank water by the heat exchange with the refrigerant in the water-refrigerant heat exchanger.

Water such as tap water and ground water normally contains hardness components such as calcium and magnesium. In the water heating system as described above, a temperature of calcium or magnesium contained in tap water or the like is increased in a heating section for tank water of the water-refrigerant heat exchanger. When the temperature exceeds a degree at which the calcium or magnesium has solubility in water, the calcium or magnesium is transformed into calcium carbonate or the like (referred to as scale below), and precipitates on a surface or the like of the water-refrigerant heat exchanger. The scale causes problems that heat exchange efficiency of the water-refrigerant heat exchanger is reduced, and a flow path is closed.

Thus, to solve the above problems, there has been proposed means for preventing scale deposition when the heat pump is stopped by stopping a compressor of the heat pump after the boiling operation is stopped, while continuing the operation of the pump to circulate the water and decrease an outlet temperature of a water-refrigerant heat exchange section to the same level as an inlet temperature (for example, see Patent Literature 1).

A water heating system described in Patent Literature 1 is a water heating system that directly exchanges heat between refrigerant and tap water, and especially in Europe, a water heating system is generally employed that circulates water heated by refrigerant and then exchanges heat between the circulated water and tap water (for example, see Patent Literature 2).

CITATION LIST

Patent Literature

Patent Literature 1: Japanese Patent Laid-Open No. 2009-243808

Patent Literature 2: Japanese Patent Laid-Open No. 2010-065852

SUMMARY OF INVENTION

Technical Problem

In the water heating systems described in Patent Literatures 1 and 2, for example, when a heat pump using R410A as the refrigerant is used as the heat source, a highest hot water storage temperature of the water heating system, which is determined by characteristics of the refrigerant, is about 60 degrees C. On the other hand, since the precipitation of calcium and/or magnesium contained in tap water starts at around 55 degrees C., the precipitation of scale occurs at about the highest hot water storage temperature of 60 degrees C. immediately before the water is boiled. Since temperatures of the refrigerant and the water become close to each other immediately before the water is boiled, heat exchange efficiency between the refrigerant and the water is reduced, and it takes a longer time until the temperature of the water is increased up to the highest hot water storage temperature. Accordingly, a problem occurs that a scale deposition amount increases in proportion to the time.

The present invention has been made to overcome the above problems, and an object of the present invention is to obtain a heat pump water heating system which reduces scale deposition in a heat exchanger.

Solution to Problem

A heat pump water heating system of the present invention includes: a first circulation circuit including a first heat source and a first circulation pump; a second circulation circuit including a second heat source having a higher temperature than the first heat source, and a second circulation pump; a third circulation circuit including a mixing tank that connects the first circulation circuit and the second circulation circuit, and a third circulation pump; a fourth circulation circuit including a hot water storage tank that stores tank water, and a fourth circulation pump; a heat exchanger that exchanges heat between water flowing through the third circulation circuit, and the tank water flowing through the fourth circulation circuit; a temperature sensor that detects a temperature of the tank water within the hot water storage tank; and a controller that controls the first circulation pump, the second circulation pump, the third circulation pump, and the fourth circulation pump, wherein the controller increases the temperature of the tank water within, if the temperature of the tank water detected from the temperature sensor is lower than a first preset temperature, the controller drives the first circulation pump, the third circulation pump, and the fourth circulation pump, and uses the first heat source to increase the temperature of the tank water within the hot water storage tank via the heat exchanger, and if the temperature of the tank water detected from the temperature sensor is equal to or higher than the first preset temperature, the controller stops the first circulation pump, drives the second circulation pump, the third circulation pump, and the fourth circulation pump, and uses the second heat source to increase the temperature of the tank water within the hot water storage tank via the heat exchanger in a shorter time than that of a case in which the first heat source is used to increase the temperature.

Advantageous Effects of Invention

In accordance with the present invention, if the temperature of the tank water detected from the temperature sensor is equal to or higher than the first preset temperature, the heat source for boiling the tank water is switched to the second heat source having a higher temperature than the first heat source, thereby increasing the temperature of the tank water within the hot water storage tank in a shorter time. Accordingly, a scale deposition amount in a plate heat exchanger that performs heat exchange between refrigerant and tank water can be reduced.

DESCRIPTION OF EMBODIMENTS

First Embodiment

Figure 1:
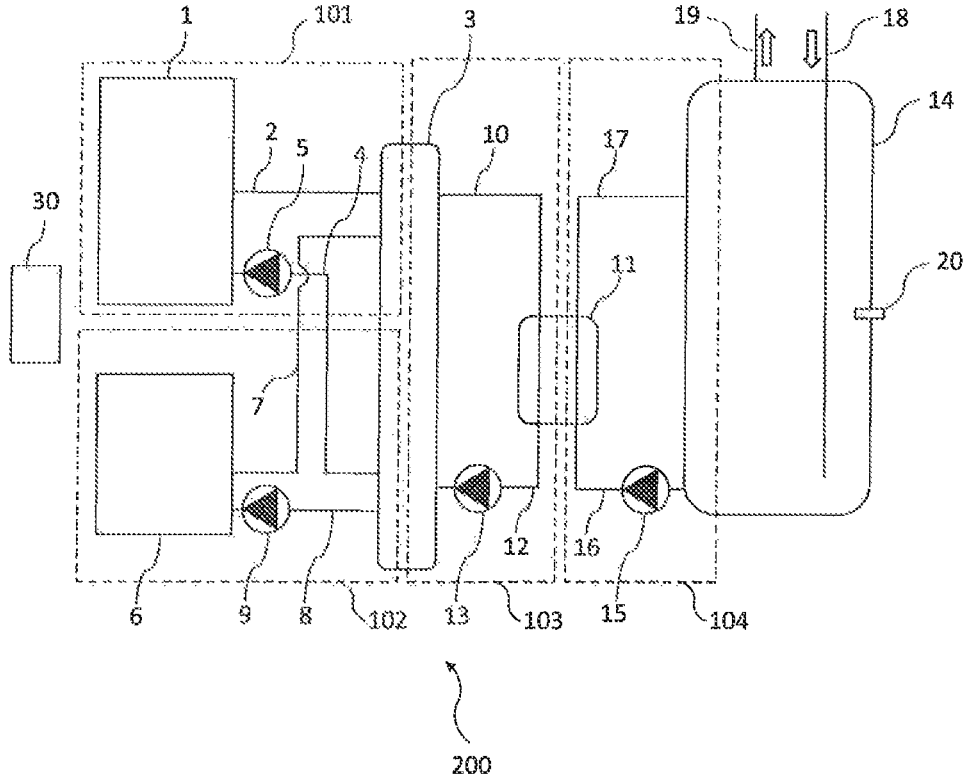
FIG. 1 is a schematic view illustrating a heat pump water heating system according to a first embodiment of the present invention.

FIG. 1 is a schematic view illustrating a heat pump water heating system according to a first embodiment of the present invention.

As shown in FIG. 1, a heat pump water heating system 200 includes a heat pump heat source circulation circuit 101, a boiler heat source circulation circuit 102, a mixing tank circulation circuit 103, a tank circulation circuit 104, a temperature sensor 20, and a controller 30.

In the heat pump heat source circulation circuit 101, a heat pump unit 1, a connection pipe 2, a mixing tank 3, a connection pipe 4, and a circulation pump 5 are connected in an annular shape. For example, a highly energy-saving heat pump is used as the heat pump unit 1 that is a heat source of the heat pump heat source circulation circuit 101, and R410A is used as refrigerant. The circulation pump 5 circulates water within the heat pump heat source circulation circuit 101 in the order of the heat pump unit 1, the connection pipe 2, the mixing tank 3, the connection pipe 4, and the heat pump unit 1.

In the boiler heat source circulation circuit 102, a boiler 6, a connection pipe 7, the mixing tank 3, a connection pipe 8, and a circulation pump 9 are connected in an annular shape. For example, a heat source such as a boiler and an electric heater that enables heating at a higher temperature than the heat pump is used as the boiler 6 that is a heat source of the boiler heat source circulation circuit 102. The circulation pump 9 circulates water within the boiler heat source circulation circuit 102 in the order of the boiler 6, the connection pipe 7, the mixing tank 3, the connection pipe 8, and the boiler 6.

In the mixing tank circulation circuit 103, the mixing tank 3, a connection pipe 10, a plate heat exchanger 11, a connection pipe 12, and a circulation pump 13 are connected in an annular shape. The circulation pump 13 circulates water within the mixing tank circulation circuit 103 in the order of the mixing tank 3, the connection pipe 10, the plate heat exchanger 11, the connection pipe 12, and the mixing tank 3.

An upper portion of the mixing tank 3 is connected to the heat pump unit 1 by the connection pipe 2, and a lower portion of the mixing tank 3 is connected to the heat pump unit 1 by the connection pipe 4 via the circulation pump 5.

Similarly, the upper portion of the mixing tank 3 is connected to the boiler 6 by the connection pipe 7, and the lower portion of the mixing tank 3 is connected to the boiler 6 by the connection pipe 8 via the circulation pump 9. Water is fed between the heat pump heat source circulation circuit 101 or the boiler heat source circulation circuit 102 and the mixing tank circulation circuit 103 through the pipes.

In the tank circulation circuit 104, a hot water storage tank 14, a circulation pump 15, a connection pipe 16, the plate heat exchanger 11, and a connection pipe 17 are connected in an annular shape. The circulation pump 15 sucks water in a bottom portion within the tank, and feeds the water to an upper portion of the tank through the connection pipe 16, the plate heat exchanger 11, and the connection pipe 17.

The hot water storage tank 14 is provided with a water supply pipe 18 that supplies tap water, and a hot water spout pipe 19 that spouts hot water. A water inlet of the water supply pipe 18 is provided in a lower portion within the hot water storage tank 14, and tap water is supplied to the lower portion within the hot water storage tank from the water supply pipe 18. A water outlet of the hot water spout pipe 19 is provided in an upper portion within the hot water storage tank 14, and hot water stored in the upper portion within the hot water storage tank 14 is spouted from the hot water spout pipe 19.

The temperature sensor 20 is installed on the hot water storage tank 14, and detects a temperature of tank water within the hot water storage tank.

The controller 30 is composed of, for example, a microcomputer. The controller 30 reads the temperature of the tank water within the hot water storage tank 14 from the temperature sensor 20, and controls start or stop of each circulation pump according to the temperature of the tank water.

A heat source switch tank temperature for switching the water circulation circuit described below is set in the controller 30. For example, the heat source switch tank temperature is set at 55 degrees C. at which a precipitation amount of calcium and/or magnesium in tap water is increased.

A tank preset temperature for stopping all the circulation pumps is also set in the controller 30. For example, the tank preset temperature is set at about 60 degrees C., which is a boiling upper-limit temperature of the hot water storage tank 14, when the heat pump using R410A as the refrigerant is used as the heat source.

Next, an operation of the heat pump water heating system 200 according to the first embodiment is described with reference to FIG. 1.

The heat pump water heating system 200 is a system in which the circulation circuit and the heat source are switched according to the temperature of the tank water within the hot water storage tank 14. Therefore, the operation of the heat pump water heating system 200 is described below based on respective cases in which the tank water within the hot water storage tank 14 has different temperatures.

When a boiling operation of the hot water storage tank 14 is started, the circulation pump 15 is activated in the tank circulation circuit 104. The tank water having a low temperature in the bottom portion within the hot water storage tank 14 is fed to the upper portion of the hot water storage tank 14 sequentially through the connection pipe 16, the plate heat exchanger 11, and the connection pipe 17. The operation is performed regardless of the temperature of the tank water until the boiling operation of the hot water storage tank 14 is terminated.

<Case in which the Temperature of the Tank Water is Less than the Heat Source Switch Tank Temperature>

If the temperature of the tank water is less than the heat source switch tank temperature (e.g., 55 degrees C.), that is, at a stage from the start of the boiling operation of the hot water storage tank 14 up to immediately before boiling, the circulation pump 5 in the heat pump heat source circulation circuit 101 is activated, and the highly energy-saving heat pump unit 1 is used as the heat source. The circulation pump 5 feeds high-temperature water heated by the heat pump unit 1 to the upper portion of the mixing tank 3 through the connection pipe 2.

The high-temperature water flowing into the upper portion of the mixing tank 3 is fed from the upper portion of the mixing tank 3 to the lower portion of the mixing tank 3 sequentially through the connection pipe 10, the plate heat exchanger 11, and the connection pipe 12 by the circulation pump 13 to be circulated within the mixing tank circulation circuit 103. At this time, the high-temperature water exchanges heat with the low-temperature tank water sucked from the bottom portion of the hot water storage tank 14 by the circulation pump 15 when passing through the plate heat exchanger 11, so that the tank water has a high temperature, and returns to the hot water storage tank 14 through the connection pipe 17.

On the other hand, the water whose temperature is decreased by exchanging heat with the low-temperature tank water in the plate heat exchanger 11 returns to the mixing tank 3, is sucked by the circulation pump 5 through the connection pipe 4, and is returned to the heat pump unit 1. The low-temperature water is boiled again by the heat pump unit 1 serving as the heat source.

<Case in which the Temperature of the Tank Water is Equal to or Higher than the Heat Source Switch Tank Temperature>

Next, the operation of the heat pump water heating system 200 in the case where the temperature of the tank water within the hot water storage tank 14 is equal to or higher than the heat source switch tank temperature (e.g., 55 degrees C.), that is, at a stage in which scale starts to precipitate in the plate heat exchanger 11 is described.

If the temperature of the tank water is equal to or higher than the heat source switch tank temperature, the controller 30 stops the circulation pump 5 and activates the circulation pump 9 in order to switch the heat source. A temperature of water is increased by the boiler 6 that enables heating at a higher temperature than the heat pump unit 1. Accordingly, the temperature of the water is increased in a shorter time than that of the case in which the temperature of the water is increased by the heat pump unit 1, thereby making short a time length in which the scale is generated. After that, the circulation pump 9 feeds the high-temperature water heated by the boiler 6 to the upper portion of the mixing tank 3 through the connection pipe 7.

The high-temperature water flowing into the upper portion of the mixing tank 3 is circulated within the mixing tank circulation circuit 103 similarly to the case described above, and the water and the tank water exchange heat in the plate heat exchanger 11. The tank water thereby has a high temperature and returns to the hot water storage tank 14 through the connection pipe 17. On the other hand, the water whose temperature is decreased by exchanging heat with the low-temperature tank water in the plate heat exchanger 11 returns to the mixing tank 3, is sucked by the circulation pump 9 through the connection pipe 8, and is returned to the boiler 6. The low-temperature water is boiled again by the boiler 6 as the heat source.

<Case in which the Temperature of the Tank Water is Equal to or Higher than the Tank Preset Temperature>

Furthermore, if the temperature of the tank water within the hot water storage tank 14 becomes equal to or higher than the tank preset temperature (e.g., 60 degrees C.), the controller 30 stops the circulation pump 9, the circulation pump 13, and the circulation pump 15 in operation in order to terminate the boiling operation of the tank water.

Figure 2:
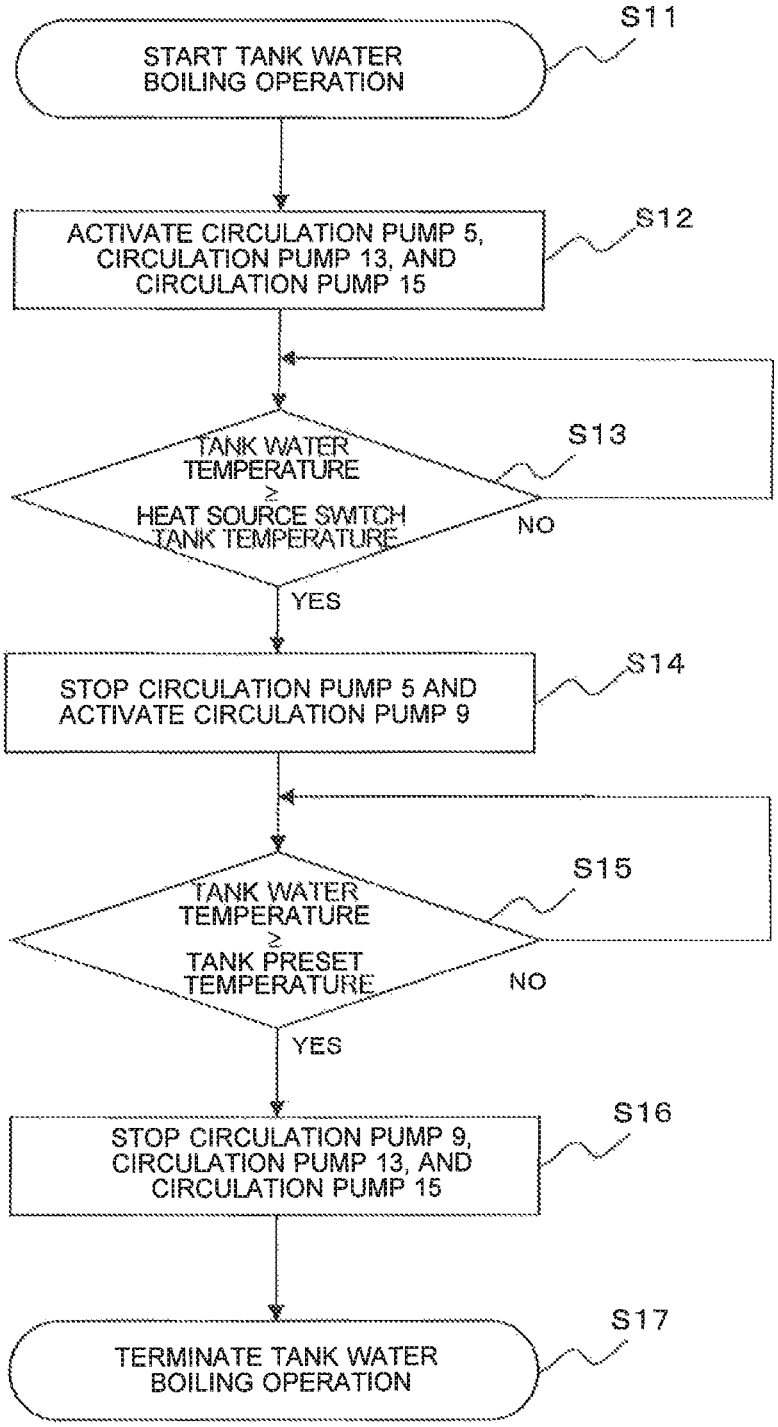
FIG. 2 is a flowchart illustrating a control operation of a controller of the heat pump water heating system according to the first embodiment of the present invention.

FIG. 2 is a flowchart illustrating a control operation of the controller 30 of the heat pump water heating system 200 according to the first embodiment of the present invention. In the following, the control operation of the controller 30 is described based on respective steps in FIG. 2 with reference to FIG. 1.

(S11)

The boiling operation of the tank water is started.

(S12)

The controller 30 activates the circulation pump 5 and the circulation pump 13, to circulate the water within the heat pump heat source circulation circuit 101 and the mixing tank circulation circuit 103. Moreover, the controller 30 activates the circulation pump 15, to circulate the water within the tank circulation circuit 104.

(S13)

The controller 30 reads the temperature of the tank water within the hot water storage tank 14 from the temperature sensor 20, and compares the temperature with the heat source switch tank temperature. If the temperature of the tank water is equal to or higher than the heat source switch tank temperature, the operation proceeds to step S14. Otherwise, the operation proceeds to step S13 again.

(S14)

In order to switch the heat source for increasing the temperature of the water from the heat pump unit 1 of the heat pump heat source circulation circuit 101 to the boiler 6 of the boiler heat source circulation circuit 102, the controller 30 stops the circulation pump 5 of the heat pump heat source circulation circuit 101, and activates the circulation pump 9 of the boiler heat source circulation circuit 102.

(S15)

The controller 30 reads the temperature of the tank water within the hot water storage tank 14 from the temperature sensor 20, and compares the temperature with the tank preset temperature. If the temperature of the tank water is equal to or higher than the tank preset temperature, the operation proceeds to step S16. Otherwise, the operation proceeds to step S15 again.

(S16)

The controller 30 stops the circulation pump 9 and the circulation pump 13, to stop the circulation of the water within the boiler heat source circulation circuit 102 and the mixing tank circulation circuit 103. Moreover, the controller 30 stops the circulation pump 15, to stop the circulation of the water within the tank circulation circuit 104.

(S17)

The boiling operation of the tank water is terminated.

By switching the heat source for increasing the temperature of the water from the highly energy-saving heat pump unit 1 to the boiler 6 having a higher temperature than the heat pump immediately before the tank water within the hot water storage tank 14 is boiled as described above, a boiling time length at a high temperature at which the scale tends to be deposited is shortened. Accordingly, a time length in which the scale precipitates is shortened, and a scale deposition amount in the plate heat exchanger 11 can be reduced.

Although R410A is cited as an example of the refrigerant of the heat pump heat source circulation circuit 101 in the first embodiment, the present invention is not limited thereto. Refrigerant such as carbon dioxide, propane, and propylene may be also used. Although the plate heat exchanger 11 is cited as an example of the heat exchanger, the present invention is not limited thereto. A shell-and-tube heat exchanger, a double-tube heat exchanger or the like may be also used.

Although the heat source switch tank temperature is set at 55 degrees C. in the first embodiment, the heat source switch tank temperature may be changed, for example, within a range of "50 degrees C.≤the heat source switch tank temperature<the tank preset temperature" according to a condition under which the scale precipitates. Moreover, although the tank preset temperature when R410A is used as the refrigerant is set at 60 degrees C., the tank preset temperature may be changed, for example, within a range of "40 degrees C.≤the tank preset temperature≤90 degrees C." according to characteristics of the refrigerant. The same applies to a second embodiment described below.

Note that the heat pump unit 1 corresponds to a "first heat source" in the present invention, and the boiler 6 corresponds to a "second heat source" in the present invention. Also, the circulation pump 5 corresponds to a "first circulation pump" in the present invention, the circulation pump 9 a "second circulation pump" in the present invention, the circulation pump 13 a "third circulation pump" in the present invention, and the circulation pump 15 a "fourth circulation pump" in the present invention.

Also, the heat pump heat source circulation circuit 101 corresponds to a "first circulation circuit" in the present invention, the boiler heat source circulation circuit 102 a "second circulation circuit" in the present invention, the mixing tank circulation circuit 103 a "third circulation circuit" in the present invention, and the tank circulation circuit 104 a "fourth circulation circuit" in the present invention.

Also, the heat source switch tank temperature corresponds to a "first preset temperature" in the present invention, and the tank preset temperature corresponds to a "second preset temperature".

Moreover, the plate heat exchanger 11 corresponds to a "heat exchanger" in the present invention.

Second Embodiment

Figure 3:
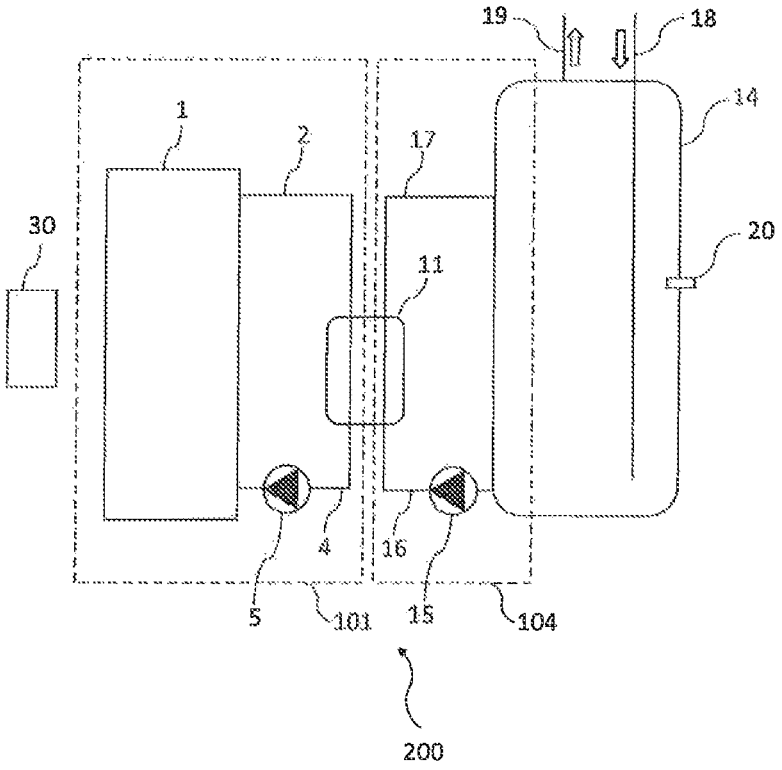
FIG. 3 is a schematic view illustrating a heat pump water heating system according to a second embodiment of the present invention.

FIG. 3 is a schematic view illustrating a heat pump water heating system 200 according to a second embodiment of the present invention. As shown in FIG. 3, the heat pump water heating system 200 includes a heat pump heat source circulation circuit 101, a tank circulation circuit 104, a temperature sensor 20, and a controller 30.

In the heat pump heat source circulation circuit 101, a heat pump unit 1, a connection pipe 2, a plate heat exchanger 11, a connection pipe 4, and a circulation pump 5 are connected in an annular shape. For example, a highly energy-saving heat pump is used as a heat source of the heat pump heat source circulation circuit 101, and R410A is used as refrigerant. The circulation pump 5 circulates water within the heat pump heat source circulation circuit 101 in the order of the heat pump unit 1, the connection pipe 2, the plate heat exchanger 11, the connection pipe 4, and the heat pump unit 1.

The tank circulation circuit 104 has the same configuration as that in the first embodiment described above.

The temperature sensor 20 is installed on the hot water storage tank 14, and detects a temperature of water within the hot water storage tank 14.

The controller 30 is composed of, for example, a microcomputer. The controller 30 reads the temperature of the tank water within the hot water storage tank 14 from the temperature sensor 20, and controls start or stop of each circulation pump according to the temperature of the tank water.

A tank preset temperature for stopping the circulation pump 15 described below is set in the controller 30. For example, the tank preset temperature is set at about 60 degrees C., which is a boiling upper-limit temperature of the hot water storage tank 14, when the heat pump using R410A as the refrigerant is used as the heat source.

Also, the controller 30 includes a timer (not shown). A time length until the plate heat exchanger 11 is cooled is previously set in the timer.

Next, an operation of the heat pump water heating system 200 according to the second embodiment is described with reference to FIG. 3.

When a boiling operation of the hot water storage tank 14 is started, the circulation pump 15 is activated. The tank water having a low temperature within the hot water storage tank 14 is fed to the upper portion of the hot water storage tank 14 from the bottom portion of the hot water storage tank 14 sequentially through the connection pipe 16, the plate heat exchanger 11, and the connection pipe 17.

The highly energy-saving heat pump unit 1 in the heat pump heat source circulation circuit 101 increases a temperature of water as the heat source. The circulation pump 5 feeds the high-temperature water heated by the heat pump unit 1 to the plate heat exchanger 11 through the connection pipe 2.

At this time, the high-temperature water flowing into the plate heat exchanger 11 exchanges heat with the low-temperature tank water in the plate heat exchanger 11. The tank water thereby has a high temperature, and returns to the hot water storage tank 14 through the connection pipe 17. On the other hand, the water whose temperature is decreased by exchanging heat with the low-temperature tank water in the plate heat exchanger 11 is sucked by the circulation pump 5, passes through the connection pipe 4, and is returned to the heat pump unit 1. The low-temperature water is boiled again by the heat pump unit 1 as the heat source.

The heat pump water heating system 200 repeats the above operation. When the temperature of the tank water reaches the tank preset temperature or more, the controller 30 stops the circulation pump 15. The controller 30 further measures the previously-set time length until the plate heat exchanger 11 is cooled (referred to as a reference time below) by using the timer, and stops the circulation pump 5 after the elapse of the reference time (for example, 10 minutes).

Figure 4:
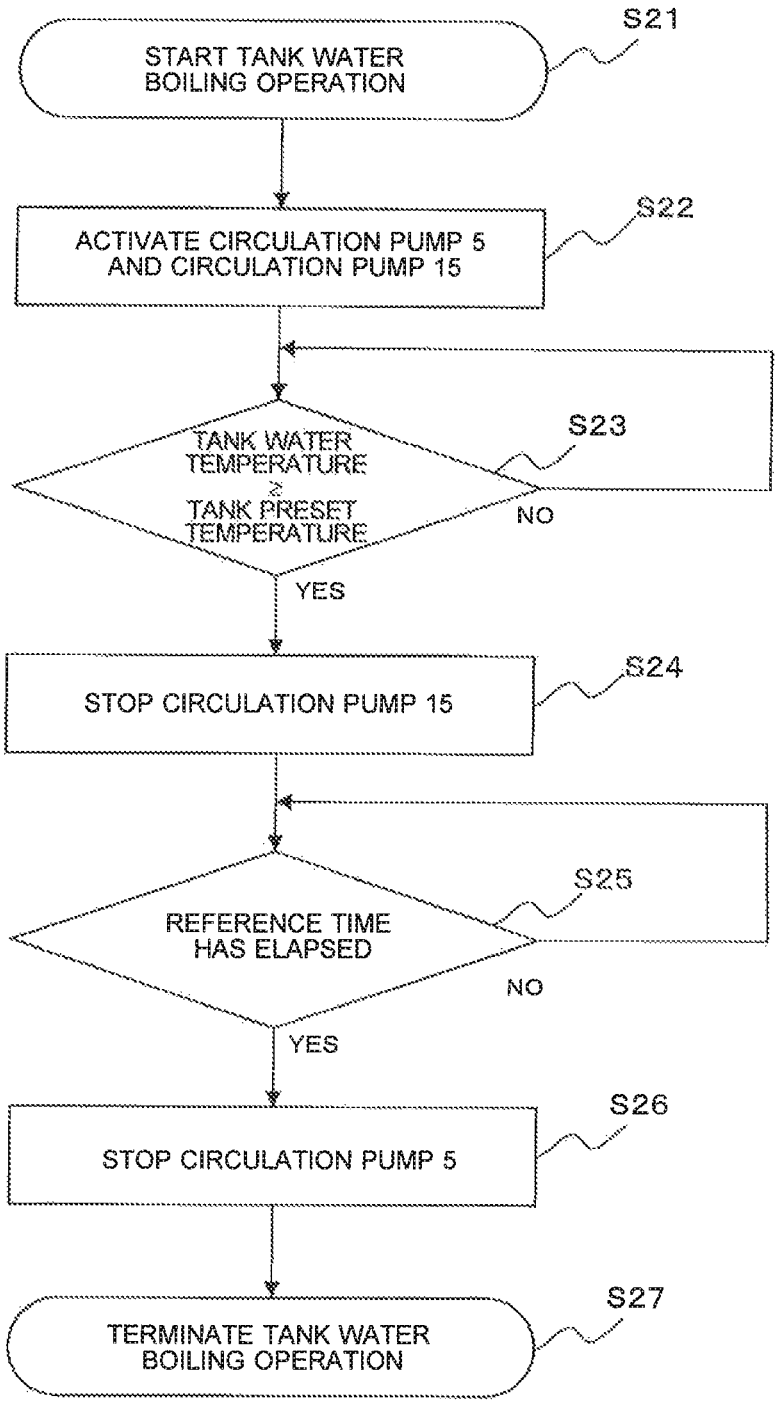
FIG. 4 is a flowchart illustrating a control operation of a controller of the heat pump water heating system according to the second embodiment of the present invention.

FIG. 4 is a flowchart illustrating a control operation of the controller 30 of the heat pump water heating system 200 according to the second embodiment of the present invention. In the following, the control operation of the controller 30 is described based on respective steps in FIG. 4 with reference to FIG. 3.

(S21)

The boiling operation of the tank water is started.

(S22)

The controller 30 activates the circulation pump 5 and the circulation pump 15, to circulate the water within the heat pump heat source circulation circuit 101 and the water within the tank circulation circuit 104.

(S23)

The controller 30 reads the temperature of the tank water within the hot water storage tank 14 from the temperature sensor 20, and compares the temperature with the tank preset temperature. If the temperature of the tank water is equal to or higher than the tank preset temperature, the operation proceeds to step S24. Otherwise, the operation proceeds to step S23 again.

(S24)

Since the tank water within the hot water storage tank has been boiled, the controller 30 stops the circulation pump 15 of the tank circulation circuit 104.

(S25)

The controller 30 reads an elapsed time from the timer. When the reference time has elapsed, the operation proceeds to step S26. Otherwise, the operation proceeds to step S25 again.

(S26) The controller 30 stops the circulation pump 5, to stop the circulation of the water within the heat pump heat source circulation circuit 101.

(S27)

The boiling operation of the tank water is terminated.

As described above, the circulation pump 15 of the tank circulation circuit 104 on the tank side is stopped immediately after the tank water within the hot water storage tank 14 reaches the tank preset temperature. On the other hand, the circulation pump 5 of the heat pump heat source circulation circuit 101 on the heat pump side continues to be operated for a certain time length, so that a temperature of the plate heat exchanger 11 is decreased by an amount of heat dissipation in the circulation circuit as compared with a case in which the circulation pump 5 is stopped after the tank water is boiled. Accordingly, a time length in which the scale precipitates is shortened, and a scale deposition amount due to stagnation of the high-temperature water can be proportionally reduced.

Note that the heat pump unit 1 corresponds to a "heat source" in the present invention, the circulation pump 5 a "heat source circulation pump" in the present invention, and the circulation pump 15 a "tank circulation pump" in the present invention. Also, the heat pump heat source circulation circuit 101 corresponds to a "heat source circulation circuit" in the present invention, and the tank circulation circuit 104 corresponds to a "tank circulation circuit" in the present invention.

REFERENCE SIGNS LIST

1 Heat pump unit, 2 Connection pipe, 3 Mixing tank, 4 Connection pipe, 5 Circulation pump, 6 Boiler, 7 Connection pipe, 8 Connection pipe, 9 Circulation pump, 10 Connection pipe, 11 Plate heat exchanger, 12 Connection pipe, 13 Circulation pump, 14 Hot water storage tank, 15 Circulation pump, 16 Connection pipe, 17 Connection pipe, 18 Water supply pipe, 19 Hot water spout pipe, 20 Temperature sensor, 30 Controller, 101 Heat pump heat source circulation circuit, 102 Boiler heat source circulation circuit, 103 Mixing tank circulation circuit, 104 Tank circulation circuit, 200 Heat pump water heating system.

The invention claimed is:

1. A heat pump water heating system comprising:

a heat source circulation circuit including a heat source and a heat source circulation pump;

a tank circulation circuit including a hot water storage tank that stores tank water, and a tank circulation pump;

a heat exchanger that exchanges heat between water flowing through the heat source circulation circuit, and the tank water flowing through the tank circulation circuit;

a temperature sensor that detects a temperature of the tank water within the hot water storage tank; and a controller that controls the heat source circulation pump and the tank circulation pump, wherein if the temperature of the tank water detected from the temperature sensor is lower than a tank preset temperature, the controller drives the heat source circulation pump and the tank circulation pump, and uses the heat source to increase the temperature of the tank water within the hot water storage tank via the heat exchanger, and if the temperature of the tank water detected from the temperature sensor is equal to or higher than the tank preset temperature, the controller stops the tank circulation pump and continues to drive the heat source circulation pump for a reference time, wherein the reference time is a predetermined length of time until the heat exchanger is cooled.

2. The heat pump water heating system of claim 1, wherein the controller stops the heat source circulation pump when the reference time elapses after the tank circulation pump is stopped.

* * * * *